US005558728A

United States Patent [19]

Kobayashi et al.

[11] Patent Number: 5,558,728

[45] Date of Patent: Sep. 24, 1996

[54] CONTINUOUS FIBER-REINFORCED TITANIUM-BASED COMPOSITE MATERIAL AND METHOD OF MANUFACTURING THE SAME

[75] Inventors: Masaru Kobayashi, Tokyo; Seiichi Suzuki, Kameda-machi; Hiroshi Iizumi, Kawasaki; Chiaki Ouchi, Yokohama, all of Japan

[73] Assignees: NKK Corporation, Tokyo; Shinanogawa Technopolis Development Organization, Nagaoka, both of Japan

[21] Appl. No.: 270,936

[22] Filed: Jul. 5, 1994

[30] Foreign Application Priority Data

Dec. 24, 1993 [JP] Japan ..... 5-345941

[51] Int. Cl.[6] ..... C22C 14/00

[52] U.S. Cl. ..... 148/421; 428/608; 428/614; 428/611; 228/190; 228/193; 228/262.71

[58] Field of Search ..... 228/262.71, 190, 228/193; 428/608, 611, 614; 148/421

[56] References Cited

U.S. PATENT DOCUMENTS 4,733,816 3/1988 Eylon et al. ..... 228/190
4,809,903 3/1989 Eylon et al. ..... 228/262.71

FOREIGN PATENT DOCUMENTS

0408313A1 1/1991 European Pat. Off. .
3-274238 12/1991 Japan .

OTHER PUBLICATIONS

Engineered Materials Handbook, vol. 1, Composites, 1987 p. 868.
Metals Handbook, Ninth Edition, vol. 7, Powder Metallurgy, 1984, p. 302.
Article entitled Ti–6A1–4V As A Matrix Material for A SiC–Reinforced Composite, by C. G. Rhodes, et al, published in Metallurgical Transactions A, vol. 18A, Dec., 1987, pp. 2151–2156.
Article entitled Mechanism of Degradation in Tensile Strength of SiC/i–6A1–4V Composite by Interfacial Reaction by A. Hirose, et al, published in Material, vol. 40, No. 448, Jan., 1991, pp. 77–83.

*Primary Examiner*—John Sheehan
*Attorney, Agent, or Firm*—Frishauf, Holtz, Goodman, Langer & Chick, P.C.

[57] ABSTRACT

A continuous fiber-reinforced Ti-based composite material comprises a Ti alloy matrix containing 3 to 7% by weight of Al, 2 to 5% by weight of v, 1 to 3% by weight of Mo, 1 to 3% by weight of Fe, 0.06 to 0.20% by weight of 0, and the balance of Ti and unavoidable impurities, and SiC continuous fibers arranged within said matrix in one direction.

16 Claims, 3 Drawing Sheets

CONTINUOUS FIBER-REINFORCED TITANIUM-BASED COMPOSITE MATERIAL AND METHOD OF MANUFACTURING THE SAME

BACKGROUND OF THE INVENTION

1. Field of the Invention

The present invention relates to a continuous fiber-reinforced Ti-based composite material and a method of manufacturing the same.

2. Description of the Related Art

Since Ti alloy exhibits excellent properties such as a high specific strength, research has been conducted in an attempt to develop mainly a space aircraft material made of a Ti alloy. In recent years, research has been directed to obtaining a Ti alloy of a further improved strength vigorous research has been made to develop a continuous fiber-reinforced metal-based composite material, hereinafter referred to as a composite material, in which a Ti alloy is allowed to contain scores of percent by volume of continuous fibers of ceramics such as SiC so as to markedly improve the strength of the composite material. The Ti alloy used for preparing the composite material is provided in many cases by a Ti(6 wt %)—Al (4 wt %)—V alloy, hereinafter referred to as Ti-64, which is excellent in, for example, the strength-ductility balance.

A hot press method is a typical method of manufacturing a composite material. In the hot press method, a metal foil used as a matrix and a reinforcing material of continuous fibers are alternately stacked one upon the other, followed by hot-pressing the stacked structure under vacuum or an inert gas atmosphere so as to manufacture a composite material. Since the hot deformation resistance of Ti-64 is rapidly increased at 800° C. or less, the hot press is generally carried out about 900° C. in the manufacture of a composite material using Ti-64.

The strength of a composite material is said to follow ideally the ROM (Rule Of Mixtures). In practice, however, the strength of a composite material is generally lower by at least 10% than the theoretical strength determined by the ROM. It is known in the art that the reduction of the strength is caused by a reaction layer formed and grown during the forming step at the fiber-matrix interface. The reduction of the strength is increased with the growth of the reaction layer, and the thickness of the interfacial reaction layer is increased with an increase in the heating temperature or the heating time as described in, for example, Akio Hirose et al., Zairyo (Materials), 40 , (1991) page 77.

According to the literature exemplified above, the strength of the composite material prepared by using Ti-64 and SiC continuous fibers is at most 90% of the theoretical value determined by the ROM. Since hot-pressing is carried out around 900° C. in the manufacture of the composite material, it is difficult to suppress sufficiently the growth of the interfacial reaction layer in the hot-pressing step, leading to the low strength noted above.

It has been proposed to add 2% by weight of Ni to Ti-64 so as to lower the hot-pressing temperature by about 60° C. and, thus, to suppress the growth of the interfacial reaction layer, i.e., to suppress reduction of the strength, as described in, for example, C. G. Rhodes et al, Metall. Trans. A, 1987, Vol. 18A, pp. 2151–56. In this case, however, the strength of the composite material is 89% of the theoretical value determined by ROM.

SUMMARY OF THE INVENTION

The present invention, which has been achieved in view of the situation described above, is intended to provide a continuous fiber-reinforced Ti-based composite material which exhibits a strength exceeding 90% of the theoretical value determined by ROM, and a method of manufacturing the same.

According to a first aspect of the present invention, there is provided a continuous fiber-reinforced Ti-based composite material, comprising a Ti alloy matrix containing 3 to 7% by weight of Al, 2 to 5% by weight of V, 1 to 3% by weight of Mo, 1 to 3% by weight of Fe, 0.06 to 0.20% by weight of O, and the balance of Ti and unavoidable impurities, and SiC continuous fibers arranged within the matrix in one direction.

According to a second aspect of the present invention, there is provided a method of manufacturing a continuous fiber-reinforced Ti-based composite material, comprising the steps of:

alternately stacking one upon the other a Ti alloy thin sheet containing 3 to 7% by weight of Al, 2 to 5% by weight of V, 1 to 3% by weight of Mo, 1 to 3% by weight of Fe, 0.06 to 0.20% by weight of O, and the balance of Ti and unavoidable impurities, and SiC continuous fibers arranged in one direction; and hot-pressing the resultant stacked structure under a vacuum of at most $10^{-1}$ Pa or an inert gas atmosphere, at a heating temperature of 700° to 850° C., under a pressure of at least 5 MPa, and with a pressurizing time of at most 10 hours.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1A:
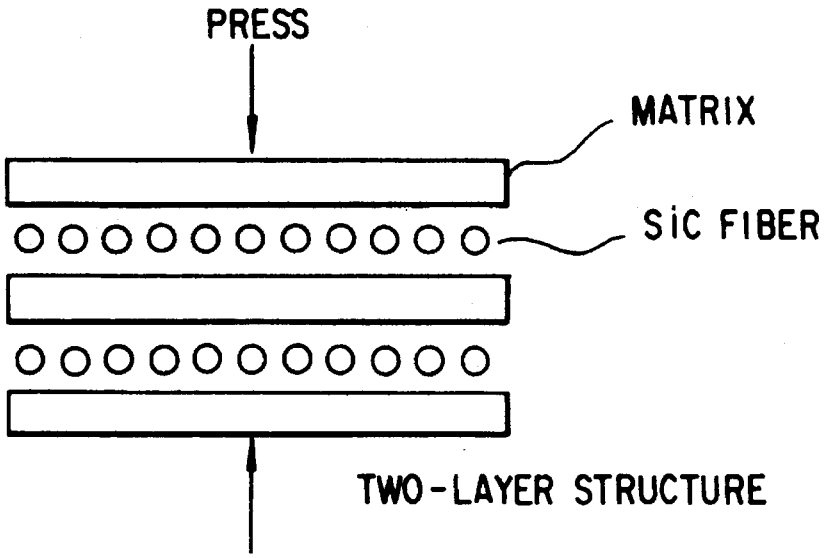
FIGS. 1A and 1B schematically show the stacking method in the manufacture of a composite material.

The present inventors have made an extensive research in an effort to obtain a continuous fiber-reinforced Ti-based composite material having a strength close to the theoretical strength determined by the ROM, and found that:

(a) Formation and growth of a reaction layer at the fiber-matrix interface can be suppressed so as to make it possible to obtain a strength close to the theoretical strength determined by the ROM, if a continuous fiber-reinforced Ti-based composite material can be formed at a temperature lower than in the conventional technique; and (b) The composite material can be formed at a lower temperature by using as a matrix a Ti alloy having a low β transformation temperature and fine microstructure, as disclosed in Japanese Patent Disclosure No. 3-274238.

The Japanese Patent document identified above discloses a Ti alloy containing 3.0 to 5.0% by weight of Al, 2.1 to 3.7% by weight of V, 0.85 to 3.15% by weight of Mo, at most 0.15% by weight of O, a predetermined amount of at least one of Fe, Ni, Co and Cr, and the balance of Ti. The Ti alloy has a low β transformation temperature, leading to a high stability of the β phase, and also has a fine microstructure. In the case of using as a matrix a Ti alloy of the composition substantially equal to that disclosed in the Japanese Patent document, a composite material can be manufactured at a temperature lower than in the prior art, making it possible to obtain a composite material having a strength exceeding 90%, ideally 99%, of the theoretical value determined by the ROM.

The present invention, which has been achieved on the basis of the technical ideas described above, provides a continuous fiber-reinforced Ti-based composite material, comprising a Ti alloy matrix containing 3 to 7% by weight of Al, 2 to 5% by weight of V, 1 to 3% by weight of Mo, 1 to 3% by weight of Fe, 0.06 to 0.20% by weight of O, and the balance of Ti and unavoidable impurities, and SiC continuous fibers arranged within said matrix in one direction.

The present invention also provides a method of manufacturing a continuous fiber-reinforced Ti-based composite material, comprising the steps of:

alternately stacking one upon the other Ti alloy thin sheets containing 3 to 7% by weight of Al, 2 to 5% by weight of V, 1 to 3% by weight of Mo, 1 to 3% by weight of Fe, 0.06 to 0.20%,by weight of O, and the balance of Ti and unavoidable impurities, and SiC continuous fibers arranged in one direction; and hot-pressing the resultant stacked structure under a vacuum of at most $10^{-1}$ Pa or an inert gas atmosphere, at a heating temperature of 700° to 850° C., under a pressure of at least 5 MPa, and with a pressurizing time of at most 10 hours.

A typical composition of the Ti alloy used in the present invention is, for example: Al (4.5 wt %)—V(3.0 wt %)—Fe(2.0 wt %)—Mo(2.0 wt %)—O (0.08 wt %)—Ti and unavoidable impurities (bal), as shown in Examples described herein later. The Ti alloy of the particular composition has a β transus of 900° C., and exhibits a particularly high transforming capability at 770° to 800° C. Thus, the heating temperature was controlled at 790°±5° C. in the Examples.

The reasons for the conditions specified in the present invention are as follows:

(Composition)

Al: Aluminum acts as an a-phase stabilizing element within the Ti alloy. It is absolutely necessary to use Al for increasing the strength of the Ti alloy. If the Al content is lower than 3% by weight, however, the Ti alloy fails to exhibit a sufficient improvement in strength. In contrast thereto, if the Al content exceeds 7% by weight, intermetallic compounds are formed within the Ti alloy so as to make the alloy brittle. It follows that the Al content is defined within a range of between 3 and 7% by weight.

V: vanadium serves to stabilize a β-phase rich in workability within the Ti alloy so as to markedly lower the β transus. If the v content is lower than 2% by weight, however, a sufficient effect of stabilizing the β phase cannot be obtained. On the other hand, if the V content exceeds 5% by weight, the β-phase stability is excessively increased so as to lower the strength of the matrix and, thus, to cause reduction in the strength of the composite material. It follows that the V content is defined within a range of between 2 and 5% by weight.

Mo: Molybdenum serves to stabilize the β-phase so as to suppress the grain growth and, thus, to make the microstructure finer. It is important to add Mo for suppressing the grain growth during manufacture of the composite material so as to prevent the matrix metal from becoming brittle. If the Mo content is lower than 1% by weight, however, a sufficient effect of suppressing the grain growth cannot be obtained. In contrast thereto, if the Mo content exceeds 3% by weight, the β-phase stability is excessively increased so as to lower the strength of the matrix and, thus, to cause reduction in the strength of the composite material. It follows that the Mo content is defined within a range of between 1 and 3% by weight.

Fe: Iron serves to stabilize the β-phase within the Ti alloy and has a large diffusion coefficient. Thus, it is important to add Fe for lowering the hot deformation resistance. However, these effects cannot be obtained, if the Fe content is lower than 1% by weight. On the other hand, if the Fe content exceeds 3% by weight, brittle intermetallic compounds are formed. It follows that the Fe content is defined within a range of between 1 to 3% by weight.

O: If oxygen is dissolved solid in the Ti alloy, a marked improvement in strength can be achieved. However, a sufficient effect of improving the strength cannot be obtained, if the O content is lower than 0.06% by weight. In contrast thereto, if the O content exceeds 0.20% by weight, the ductility of the Ti alloy is markedly lowered. It follows that the O content is defined within a range of between 0.06 and 0.20% by weight.

(2) SiC Continuous Fiber

The SiC fibers used in the present invention are not particularly restricted. It is possible to use SiC fibers known in this technical field including, for example, SiC fibers prepared by growing SiC on a core wire of C or W by CVD (Chemical Vapor Deposition) and SiC fibers prepared from a polymer by a melt spinning method. The volume ratio of the fiber within the composite material should be determined in view of the aimed level of the strength and, thus, is not particularly specified in the present invention. In general, the volume ratio noted above is set at about 10 to 50%. In the Examples described herein later, used were SiC fibers prepared by growing SiC on a carbon core wire by CVD method.

(Manufacturing Method)

Atmosphere: It is desirable to apply hot-pressing under vacuum in order to prevent the composite material from being oxidized. However, the oxidation cannot be prevented during the manufacturing process if the degree of vacuum is lower than $10^{-1}$ Pa, making it necessary to set the degree of vacuum at a level not lower than $10^{-1}$ Pa. It is desirable to set the upper limit of the vacuum degree at $10^{-1}$ Pa in view of the cost, though no inconvenience is brought about even if the degree of vacuum is higher than the level noted above. Further, it is possible to apply the hot-pressing under an inert gas atmosphere for preventing the oxidation of the composite material.

Heating Temperature: The hot deformation resistance of the Ti alloy used in the present invention is rapidly increased at 700° C. or lower. If the heating temperature exceeds 850° C., however, it is impossible to suppress sufficiently the growth of a reaction layer at the fiber-matrix interface during the manufacturing process of the composite material. It follows that the heating temperature is defined within a range of between 700° C. and 850° C.

Pressure: It is desirable for the pressure to be as high as possible unless the continuous fibers are not cracked during the manufacturing process of the composite material. Thus, the upper limit of the pressure is not specified in the present invention. On the other hand, if the pressure is lower than 5 MPa, the manufacturing time is rendered long. In addition, it is impossible to suppress sufficiently the growth of the reaction layer at the fiber-matrix interface. It follows that the pressure is defined not lower than 5 MPa.

Hot-Pressing Time: The optimum hot-pressing time depends on the pressure and temperature in the hot-pressing process. In any case, however, a sufficient effect of suppressing the growth of the reaction layer at the fiber-matrix interface cannot be obtained, if the hot-pressing time exceeds 10 hours. Naturally, the hot-pressing time should be not longer than 10 hours.

EXAMPLES

Used as a matrix was a Ti alloy thin sheet containing 4.6% by weight of Al, 2.9% by weight of V, 2.1% by weight of Fe, 2.1% by weight of Mo, 0.08% by weight of O, and the balance of Ti and unavoidable impurities. Also used as reinforcing fibers were SiC continuous fibers each having a diameter of 140 μm. The SiC continuous fibers were prepared by growing SiC on a carbon filament by CVD, followed by increasing the carbon concentration on the surface region. Table 1 shows the properties of the raw materials used.

TABLE 1

| Raw Material | Density ($g/cm^3$) | Young's Modulus (GPa) | Strength (MPa) |
|---|---|---|---|
| Matrix | 4.54 | 112 | 930 |
| Continuous Fiber | 3.00 | 400 | 3450 |

Figure 1B:
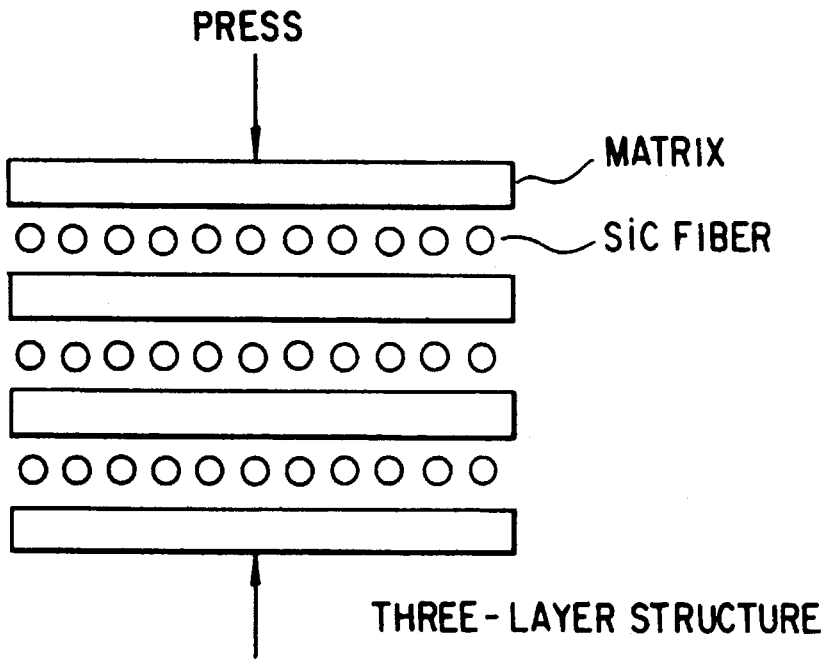
Figure 2:
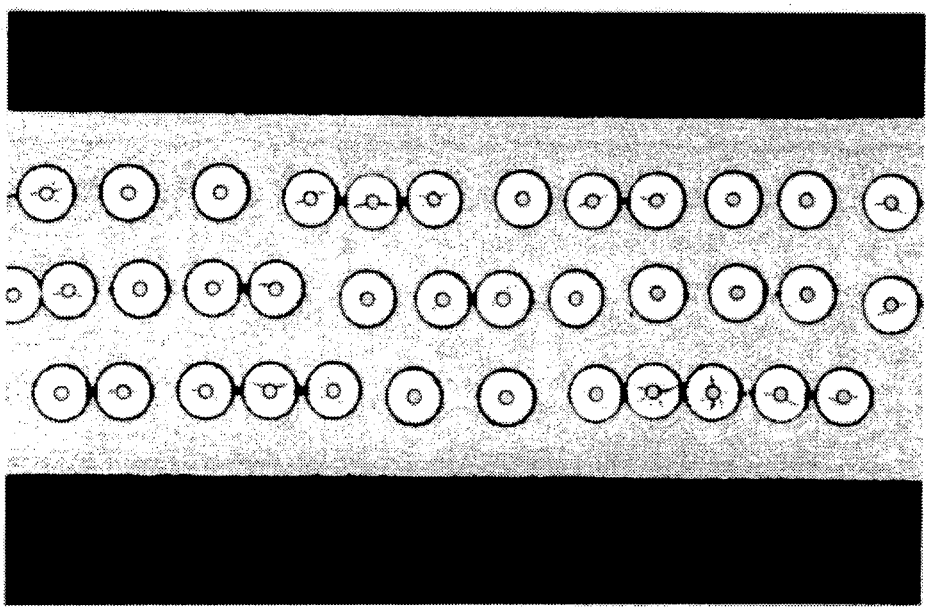
FIG. 2 is a photo showing the microstructure of Sample No. 1 of the present invention.
Figure 3:
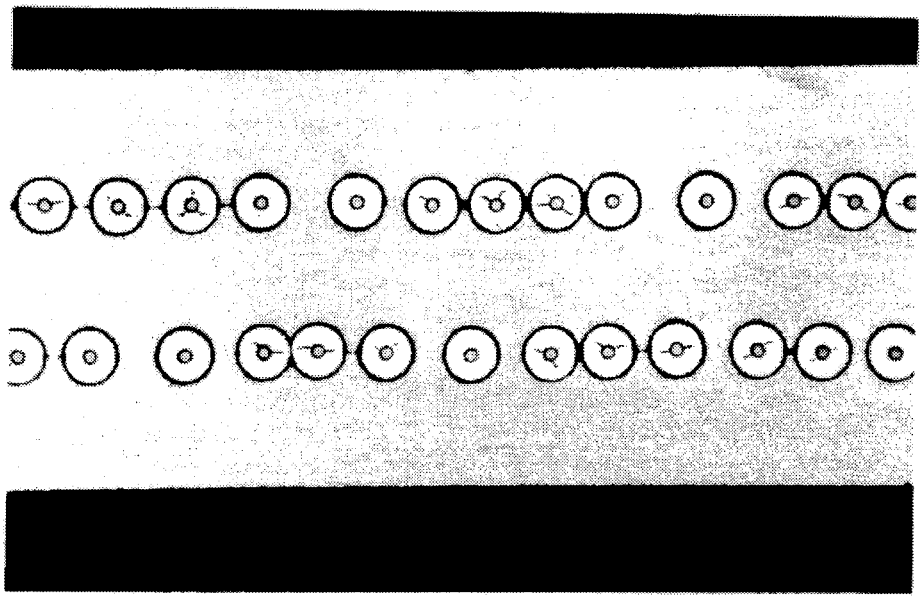
FIG. 3 is a photo showing the microstructure of Sample No. 2 of the present invention.
Figure 4:
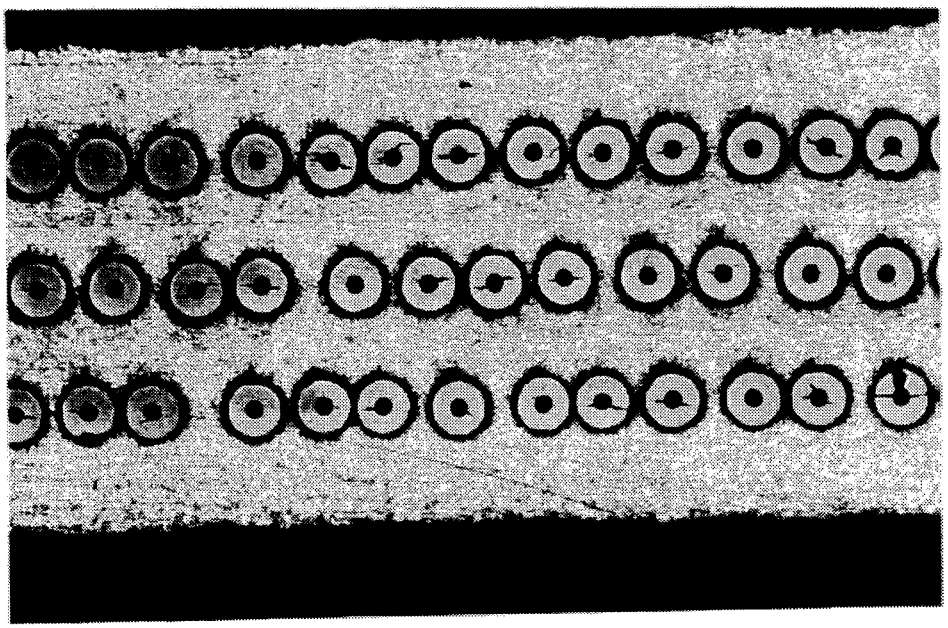
FIG. 4 is a photo showing the microstructure of Sample No. 3 of the present invention.
Figure 5:
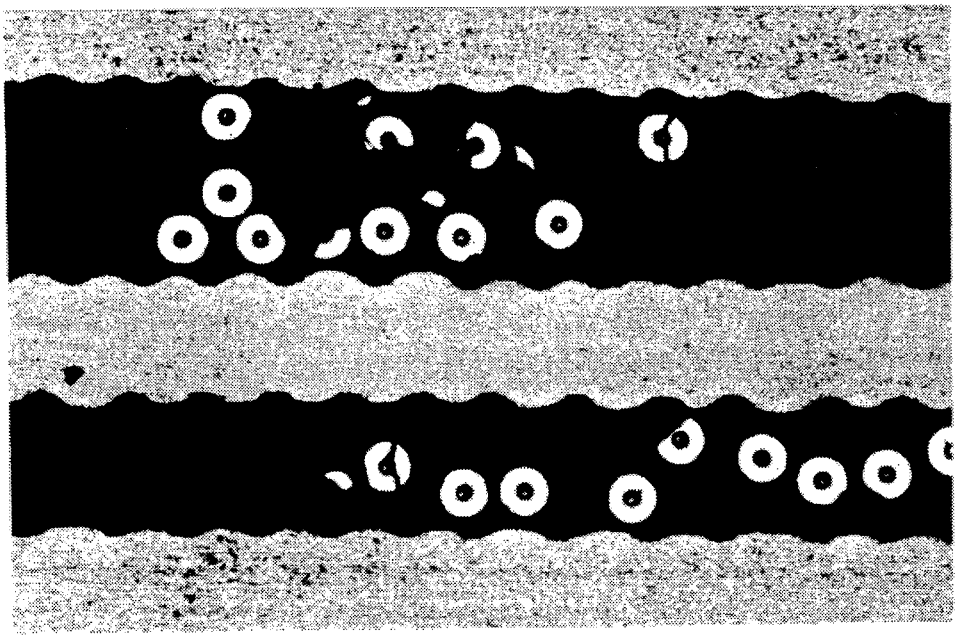
FIG. 5 is a photo showing the microstructure of Sample No. 7 of the comparative example.

FIGS. 1A and 1B show how Ti alloy matrix layers and continuous fiber layers were alternately stacked one upon the other. The thickness of the matrix layer was controlled by applying a cold rolling treatment before the hot-pressing step. Also, the volume ratio of the fiber was controlled by using two or three fiber layers. As described previously, the heating temperature was controlled at 790°±5° C. The hot-pressing was performed under a vacuum of $10^{-1}$ Pa. The density of the composite material thus prepared was measured so as to determine the ratio relative to the theoretical value.

Table 2 shows the manufacturing conditions, volume ratio of the fiber, density, and ratio of the measured density to the theoretical density. Samples 1 to 5 shown in Table 2 were prepared under the conditions falling within the scope of the present invention, with the manufacturing conditions for Samples 6 to 8 failing to fall within the scope of the present invention. Table 2 also includes a column of evaluation to determine whether a satisfactory composite material has been prepared. The evaluation was based on the ratio of the measured density of the composite material to the theoretical value. Where the density of the composite material was more than 98% of the theoretical value determined by ROM, the composite material was evaluated as satisfactory (o). Of course, Sample 7, in which two matrix layers having a fiber layer interposed therebetween were clearly peeled off, was evaluated as unsatisfactory (x). The theoretical value determined by the ROM was calculated by using the values shown in Table 1. FIGS. 2 to 5 are micrographs, magnification of 50, of Samples 1 to 3 and 7, respectively.

TABLE 2

| Sample No. | Pressure (MPa) | Treating Time (h) | Volume Ratio of Fiber (%) | Density (g/cc) Theoretical Value | Measured Value | Measured Value/ Theoretical Value | Evaluation |
|---|---|---|---|---|---|---|---|
| 1 | 9.8 | 5.3 | 27 | 4.12 | 4.07 | 98.8 | o |
| 2 | 9.8 | 6 | 16 | 4.30 | 4.27 | 99.3 | o |
| 3 | 16.3 | 6 | 23 | 4.19 | 4.14 | 98.9 | o |
| 4 | 16.3 | 4 | 27 | 4.12 | 4.08 | 99.0 | o |
| 5 | 35 | 1 | 27 | 4.12 | 4.05 | 98.3 | o |
| 6 | 4.9 | 12 | 16 | 4.30 | 4.26 | 99.1 | o |
| 7 | 4.9 | 2 | 16 | 4.30 | Peeling | — | x |
| 8 | 4.5 | 8 | 16 | 4.30 | 4.09 | 95.1 | x |

As shown in Table 2, a satisfactory composite material was prepared in each of Samples 1 to 6. These Samples 1 to 6 were subjected to a tensile test to evaluate the properties thereof, with the results as shown in Table 3. The theoretical value determined by the ROM was calculated by using the values shown in Table 1. Table 3 also includes a column of evaluation to determine whether a satisfactory composite material has been prepared. The evaluation was based on the ratio of the measured strength of the composite material to the theoretical value determined by the ROM. Where the strength of the composite material was more than 90% of the theoretical value, the composite material was evaluated as satisfactory (o). Of course, the mark (x) for Sample 6 denotes that the composite material was unsatisfactory.

TABLE 3

| No. | Volume Ratio of Fiber (%) | Young's Modulus (GPa) Theoretical Value | Measured Value | Measure Value/ Theoretical Value | Strength (MPa) Theoretical Value | Measured Value | Measured Value/ Theoretical Value | Evaluation |
|---|---|---|---|---|---|---|---|---|
| 1 | 27 | 190 | 173 | 91.1 | 1610 | 1596 | 99.1 | ○ |
| 2 | 16 | 158 | 145 | 91.8 | 1333 | 1229 | 92.4 | ○ |
| 3 | 23 | 178 | 166 | 93.3 | 1510 | 1456 | 96.4 | ○ |
| 4 | 27 | 190 | 174 | 91.6 | 1610 | 1541 | 95.7 | ○ |
| 5 | 27 | 190 | 175 | 92.1 | 1610 | 1592 | 98.9 | ○ |
| 6 | 27 | 190 | 174 | 91.6 | 1610 | 1423 | 88.7 | X |

Table 3 clearly shows that the reduction from the theoretical strength determined by the ROM can be suppressed to a level of less than 10%, or a strength more than 90% of the theoretical value can be obtained, if the hot-pressing is carried out under the conditions specified in the present invention. Particularly, such a high strength as 99.1% of the theoretical value determined by ROM was obtained in Sample 1.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A continuous fiber-reinforced Ti-based composite material, comprising a Ti alloy matrix containing 3 to 7% by weight of Al, 2 to 5% by weight of V, 1 to 3% by weight of Mo, 1 to 3% by weight of Fe, 0.06 to 0.20% by weight of O, and a balance of Ti and unavoidable impurities, and SiC continuous fibers arranged within said matrix in one direction, said composite material having a strength exceeding 90% of a theoretical value obtained by the rules of mixtures.

2. The continuous fiber-reinforced Ti-based composite material according to claim 1, wherein the SiC continuous fiber is contained in the composite material in an amount of 10 to 50% by volume.

3. A method of manufacturing a continuous fiber-reinforced Ti-based composite material, comprising the steps of:

alternately stacking one upon the other a Ti alloy thin plate containing 3 to 7% by weight of Al, 2 to 5% by weight of V, 1 to 3% by weight of Mo, 1 to 3% by weight of Fe, 0.06 to 0.20% by weight of O, and a balance of Ti and unavoidable impurities, and SiC continuous fibers arranged in one direction; and hot-pressing the resultant stacked structure under a vacuum of at most $10^{-1}$ Pa or an inert gas atmosphere, at a heating temperature of 700° to 850° C., under a pressure of at least 5 MPa, and with a pressurizing time of at most 10 hours.

4. The continuous fiber-reinforced Ti-based composite material according to claim 1, wherein the Ti alloy matrix has a composition of 4.5 wt. % Al, 3.0 wt. % V, 2.0 wt. % Fe, 2.0 wt. % Mo, 0.08 wt. % O and the balance being Ti and unavoidable impurities, said alloy having a β transus of 900° C.

5. The continuous fiber-reinforced Ti-based composite material according to claim 1, wherein the Ti alloy matrix has a composition of 4.6 wt. % Al, 2.9 wt. % V, 2.1 wt. % Fe, 2.1 wt. % Mo, 0.08 wt. % O and the balance being Ti and unavoidable impurities.

6. The continuous fiber-reinforced Ti-based composite material according to claim 5, wherein the SiC fibers have a diameter of 140 μm.

7. The continuous fiber-reinforced Ti-based composite material according to claim 1, wherein the SiC continuous fiber is contained in the composite material in an amount of 16 to 27% by volume.

8. The continuous fiber-reinforced Ti-based composite material according to claim 1, wherein the composite material has a Young's modulus of 145 to 175.

9. The continuous fiber-reinforced Ti-based composite material according to claim 1, wherein the composite material has a strength of 1229 to 1596 MPa.

10. The continuous fiber-reinforced Ti-based composite material according to claim 8, wherein the composite material has a strength of 1229 to 1596 MPa.

11. The continuous fiber-reinforced Ti-based composite material according to claim 1, wherein the composite material has a strength of 92.4 to 99.1% of the theoretical value.

12. The continuous fiber-reinforced Ti-based composite material according to claim 1, wherein the composite material has a strength of 99% of the theoretical value.

13. The method according to claim 3, wherein the pressure is 9.8 to 35 MPa.

14. The method according to claim 3, wherein the pressurizing time is 1 to 6 hours.

15. The method according to claim 3, wherein the heating temperature is 790°±5° C.

16. The method according to claim 3 wherein the pressurizing time is 3 to 6 hours and the heating temperature is 790°±5° C.

* * * * *

UNITED STATES PATENT AND TRADEMARK OFFICE

CERTIFICATE OF CORRECTION

PATENT NO. : 5,558,728

DATED : September 24, 1996

INVENTOR(S) : Masaru KOBAYASHI et al.

It is certified that error appears in the above-indentified patent and that said Letters Patent is hereby corrected as shown below:

Title Page, Item [57] ABSTRACT, line 3, replace "v" with --V--;

Column 8, line 34, after "175" insert --GPa--.

Signed and Sealed this

Eighth Day of July, 1997

Bruce Lehman

*Attest:*

BRUCE LEHMAN

*Attesting Officer*

*Commissioner of Patents and Trademarks*